US008229320B2

(12) United States Patent
Kimizuka et al.

(10) Patent No.: US 8,229,320 B2
(45) Date of Patent: Jul. 24, 2012

(54) ELECTROPHOTOGRAPHIC IMAGE FORMING APPARATUS, CARTRIDGE, AND CARTRIDGE HOLDING MEMBER WITH LOCK AND LOCK RELEASING MEMBERS FOR RELEASABLY LOCKING CARTRIDGE TO THE CARTRIDGE HOLDING MEMBER

(75) Inventors: Eiichiro Kimizuka, Mishima (JP); Masayuki Fukuda, Mishima (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 878 days.

(21) Appl. No.: 12/118,225

(22) Filed: May 9, 2008

(65) Prior Publication Data

US 2008/0286000 A1 Nov. 20, 2008

(30) Foreign Application Priority Data

May 15, 2007 (JP) ..... 2007-128988
Apr. 23, 2008 (JP) ..... 2008-112004

(51) Int. Cl.
*G03G 21/16* (2006.01)

(52) U.S. Cl. ..... 399/111

(58) Field of Classification Search ..... 399/111, 399/119, 227
See application file for complete search history.

(56) References Cited

U.S. PATENT DOCUMENTS 5,444,515 A 8/1995 Haneda et al.
6,002,898 A 12/1999 Yokomori et al.
6,385,416 B1 5/2002 Horikawa et al. ..... 399/111
6,438,327 B1 8/2002 Kimizuka et al. ..... 399/12
6,608,980 B2 8/2003 Murayama et al. ..... 399/111
6,714,752 B2 3/2004 Ueno et al. ..... 399/117
6,823,153 B2 11/2004 Ueno et al. ..... 399/103
6,829,455 B2 12/2004 Yasumoto et al. ..... 399/167
6,834,173 B2 12/2004 Yamaguchi et al. ..... 399/119
6,859,626 B2 2/2005 Kimizuka et al. ..... 399/12
6,898,391 B2 5/2005 Numagami et al. ..... 399/90
6,912,365 B2 6/2005 Ueno et al. ..... 399/25
6,947,687 B2 9/2005 Yamaguchi et al. ..... 399/111
6,954,601 B2 10/2005 Numagami et al. ..... 399/90
6,961,528 B2 * 11/2005 Yamaguchi et al. ..... 399/119
6,968,146 B1 11/2005 Fujita et al. ..... 399/258

(Continued)

FOREIGN PATENT DOCUMENTS

JP 6-019236 1/1994

(Continued)

OTHER PUBLICATIONS

Machine English Translation of Japanese Patent JP06-019236 published on Jan. 28, 1994.*

(Continued)

*Primary Examiner* — David Grey
*Assistant Examiner* — Billy J Lactaoen
(74) *Attorney, Agent, or Firm* — Fitzpatrick, Cella, Harper & Scinto

(57) ABSTRACT

An electrophotographic image forming apparatus to which a cartridge is detachably mountable to form an image on a recording medium, the electrophotographic image forming apparatus including: a mounting portion to which the cartridge is detachably mountable; a cartridge holding member which holds the cartridge to move the cartridge to the mounting portion; a lock member which releasably locks the cartridge to the cartridge holding member; and a lock releasing member which releases the lock of the cartridge to the cartridge holding member by the lock member after the cartridge holding member moves the cartridge to the mounting portion.

12 Claims, 15 Drawing Sheets

U.S. PATENT DOCUMENTS

| | | | | |
|---|---|---|---|---|
| 6,978,099 | B2 | 12/2005 | Ueno et al. | 399/103 |
| 7,003,247 | B2 | 2/2006 | Koishi et al. | 399/167 |
| 7,062,200 | B2 | 6/2006 | Ueno et al. | 399/111 |
| 7,092,658 | B2 | 8/2006 | Yasumoto et al. | 399/167 |
| 7,139,502 | B2 | 11/2006 | Koishi et al. | 399/93 |
| 7,164,875 | B2 | 1/2007 | Miyabe et al. | 399/111 |
| 7,174,122 | B2 | 2/2007 | Fujita et al. | 399/258 |
| 7,184,690 | B2 | 2/2007 | Ueno et al. | 399/117 |
| 7,209,682 | B2 | 4/2007 | Numagami et al. | 399/167 |
| 7,248,810 | B2 | 7/2007 | Miyabe et al. | 399/90 |
| 7,315,710 | B2 | 1/2008 | Ueno et al. | 399/117 |
| 7,366,452 | B2 | 4/2008 | Fujita et al. | 399/258 |
| 2006/0051133 | A1 | 3/2006 | Koishi et al. | 399/167 |
| 2006/0228127 | A1 | 10/2006 | Miyabe et al. | 399/90 |
| 2006/0251445 | A1 | 11/2006 | Ueno et al. | 399/102 |
| 2006/0269318 | A1 | 11/2006 | Ueno et al. | 399/106 |
| 2007/0110478 | A1 | 5/2007 | Numagami et al. | 399/167 |
| 2008/0159772 | A1* | 7/2008 | Koishi et al. | 399/90 |

FOREIGN PATENT DOCUMENTS

| | | |
|---|---|---|
| JP | 6-250450 | 9/1994 |
| JP | 11-73012 | 3/1999 |
| JP | 2003-202793 | 7/2003 |

OTHER PUBLICATIONS

Office Action in Japanese Patent Application No. 2008-112004, dated Nov. 22, 2011 (with translation).

* cited by examiner

ELECTROPHOTOGRAPHIC IMAGE FORMING APPARATUS, CARTRIDGE, AND CARTRIDGE HOLDING MEMBER WITH LOCK AND LOCK RELEASING MEMBERS FOR RELEASABLY LOCKING CARTRIDGE TO THE CARTRIDGE HOLDING MEMBER

BACKGROUND OF THE INVENTION

1. Field of the Invention

The present invention relates to a cartridge detachably mountable to a main body of an electrophotographic image forming apparatus, an electrophotographic image forming apparatus to which the cartridge is detachably mountable, and a cartridge holding member, which moves the cartridge.

2. Description of the Related Art

In the present day, an electrophotographic image forming apparatus such as a color laser printer is widely used. As the image forming apparatus, the electrophotographic image forming apparatus of the rotary developing type is known. A plurality of developing cartridges are mounted to a rotatable rotary Then, the rotary is rotated to oppose the developing cartridges of the respective colors to an electrophotographic photosensitive drum to form a color image.

In the image forming apparatus, a configuration for facilitating a mounting/detaching operation of the developing cartridge to/from a developing cartridge mounting portion provided in a main body of the image forming apparatus is required when the developing cartridge is to be replaced by a new one. In the image forming apparatus of the rotary developing type, in particular, it is required to lock the developing cartridge to the main body of the image forming apparatus to prevent the developing cartridge from falling out of the rotating rotary when the rotary to which the developing cartridge is mounted is rotated and to release the lock when the developing cartridge is to be detached from the rotary.

In order to satisfy the above-mentioned requirement, there exists the following configuration. A handle part is provided in the middle of the cartridge in a longitudinal direction. Then, the handle part is gripped to make the cartridge mountable/detachable to/from the apparatus main body. By the operation of the handle part, the developing cartridge is locked to the apparatus main body and the lock is released (Japanese Patent Application Laid-Open No. 2003-202793).

With the recent reduction of the size of the apparatus main body along with that of the developing cartridge, however, it becomes more and more difficult to ensure a sufficient space required for the operation In view of such a situation, a configuration which provides good operability in mounting and detaching even when the developing cartridge is reduced in size is expected.

SUMMARY OF THE INVENTION

The present invention is devised in view of the above-mentioned problem and has an object of providing an electrophotographic image forming apparatus, a cartridge, and a cartridge holding member, which provide good operability in mounting and detaching even when the cartridge is reduced in size.

Another object of the present invention is to provide an electrophotographic image forming apparatus, a cartridge, and a cartridge holding member, which provide good operability in mounting and detaching to/from a main body of the apparatus.

Still another object of the present invention is to provide an electrophotographic image forming apparatus, a cartridge, and a cartridge holding member, which provide good operability in mounting and detaching when the cartridge reduced in size is mounted/detached to/from a rear portion of the main body of the apparatus.

Still another object of the present invention is to provide an electrophotographic image forming apparatus, a cartridge, and a cartridge holding member, which provide good operability in mounting to a main body of the apparatus.

Still another object of the present invention is to provide an electrophotographic image forming apparatus, a cartridge, and a cartridge holding member, which provide good operability in detaching from a main body of the apparatus.

In order to solve the above-mentioned problem, one representative aspect of the present invention includes an electrophotographic image forming apparatus, to which a cartridge is detachably mountable to form an image on a recording medium, the electrophotographic image forming apparatus including: a mounting portion to which the cartridge is detachably mountable; a cartridge holding member which holds the cartridge to move the cartridge to the mounting portion; a lock member which releasably locks the cartridge to the cartridge holding member; and a lock releasing member which releases the lock of the cartridge to the cartridge holding member by the lock member after the cartridge holding member moves the cartridge to the mounting portion.

In order to solve the above-mentioned problem, another representative aspect of the present invention includes a cartridge detachably mountable to a main body of an electrophotographic image forming apparatus for forming an image on a recording medium, the cartridge including: a first locked portion to be releasably locked to a lock member to lock the cartridge to a cartridge holding member which moves the cartridge from outside of the main body to a mounting portion provided in the main body when the cartridge is mounted to the mounting portion; and a second locked portion to be releasably locked to a mounting portion locking member to releasably lock the cartridge to the mounting portion.

In order to solve the above-mentioned problem, still another representative aspect of the present invention includes a cartridge holding member for moving a cartridge to a mounting portion provided in a main body of an electrophotographic image forming apparatus for forming an image on a recording medium, the cartridge holding member including: a lock member to be releasably locked to a first locked portion of the cartridge to move the cartridge from outside of the main body to the mounting portion when the cartridge is to be mounted to the mounting portion; and a space portion provided for allowing a lock releasing member provided in the main body to be brought into contact with the lock member to release a lock state by the lock member.

The present invention can provide the electrophotographic image forming apparatus, the cartridge, and the cartridge holding member, which provide good operability in mounting and detaching even when the cartridge is reduced in size.

The present invention can further provide the electrophotographic image forming apparatus, the cartridge, and the cartridge holding member, which provide good operability in mounting and detaching to/from the main body of the apparatus.

The present invention can further provide the electrophotographic image forming apparatus, the cartridge, and the cartridge holding member, which provide good operability in mounting and detaching when the cartridge reduced in size is mounted/detached to/from the rear portion of the main body of the apparatus.

The present invention can further provide the electrophotographic image forming apparatus, the cartridge, and the cartridge holding member, which provide good operability in mounting to the main body of the apparatus.

The present invention can further provide the electrophotographic image forming apparatus, the cartridge, and the cartridge holding member, which provide good operability in detaching from the main body of the apparatus.

Further features of the present invention will become apparent from the following description of exemplary embodiments with reference to the attached drawings.

DESCRIPTION OF THE EMBODIMENTS

Next, an electrophotographic image forming apparatus (hereinafter, referred to simply as an "image forming apparatus"), to which a developing cartridge is mounted to form an image, according to an embodiment of the present invention is described referring to the accompanying drawings.

First Embodiment

Figure 1:
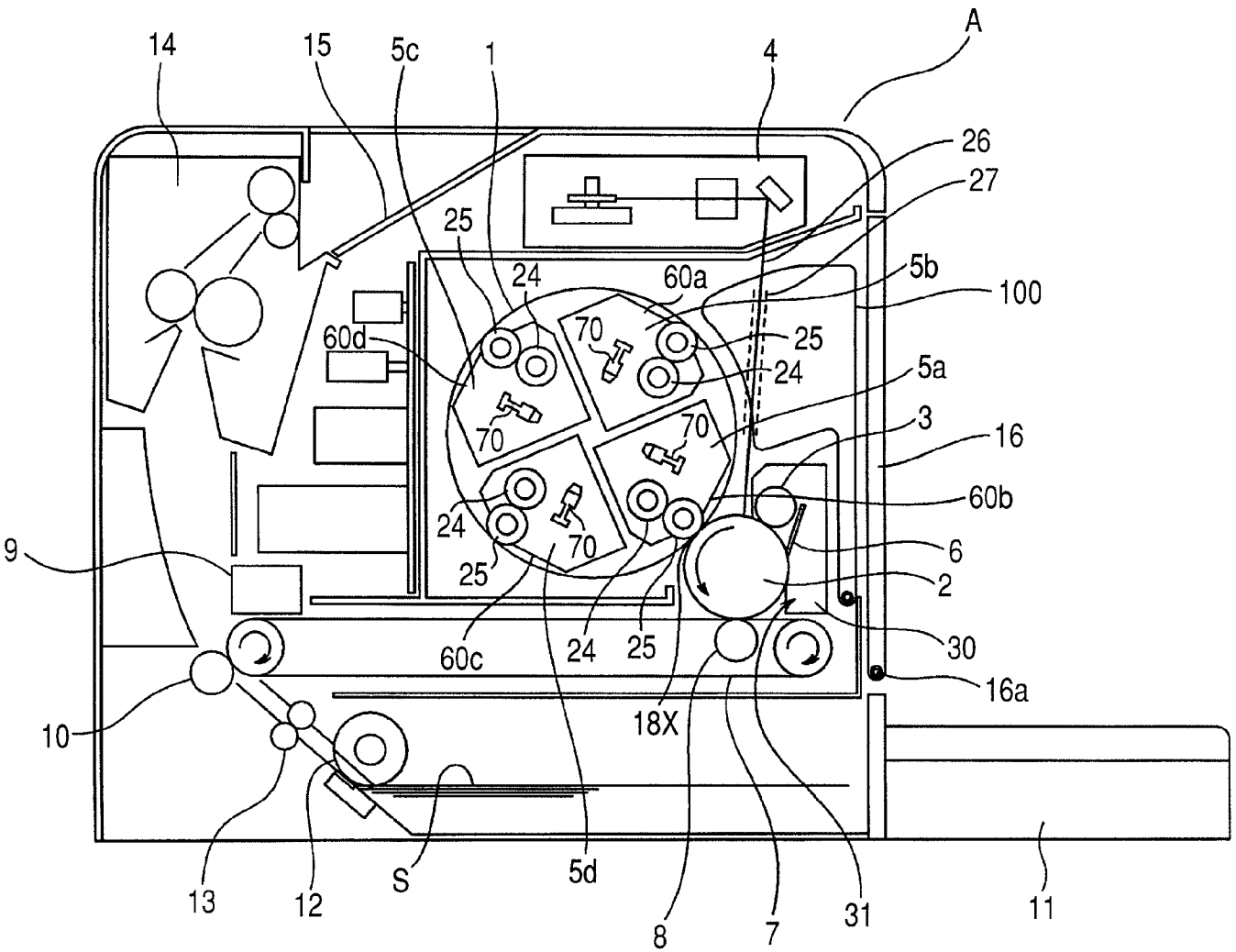
FIG. 1 is an overall schematic explanatory view of a full-four-color laser beam printer corresponding to an image forming apparatus according to a first embodiment of the present invention.

FIG. 1 is an overall schematic explanatory view of a full-four-color laser beam printer corresponding to the image forming apparatus according to the first embodiment of the present invention. First, referring to FIG. 1, an overall configuration of the image forming apparatus according to this first embodiment as well as its image forming operation are described.

(Electrophotographic Image Forming Apparatus)

In the embodiment described below, cartridges (developing cartridges 5 and a process cartridge 30) are detachably mounted to the electrophotographic image forming apparatus to allow the electrophotographic image forming apparatus to form an image on a sheet S (recording medium).

As illustrated in FIG. 1, a photosensitive drum 2 corresponding to a drum-shaped electrophotographic photosensitive member is provided approximately in the center of the image forming apparatus according to this embodiment. Around the photosensitive drum 2, a charging roller 3 for uniformly charging the photosensitive drum 2 and exposure means 4 for irradiating the photosensitive drum 2 with a laser beam according to image information to form an electrostatic latent image are provided. Around the photosensitive drum 2, developing devices (developing cartridges) 5 for developing the electrostatic latent image formed on the photosensitive drum 2 with developers and a cleaning device 6 for removing a residual toner on the photosensitive drum 2 are also provided.

The developing apparatus in this first embodiment is a rotary type developing apparatus including the developing cartridges 5 (5*a*, 5*b*, 5*c*, 5*d*) obtained by making a plurality of (four) developing means into cartridges, which are mountable to and detachable from a rotatable rotary 1. Specifically, the developing apparatus uses the developers to develop the electrostatic latent image formed on the photosensitive drum 2. The cartridge 5*a* contains a yellow developer therein and uses the yellow developer to develop the latent image. Similarly, the cartridge 5*b* contains a magenta developer therein and uses the magenta developer to develop the latent image, the cartridge 5*c* contains a cyan developer therein and uses the cyan developer to develop the latent image, and the cartridge 5*d* contains a black developer therein and uses the black developer to develop the latent image. The cartridges 5 differ from each other only in the color of the developer contained therein and have the same configuration. Each of the cartridges 5*a* to 5*d* has a developing roller (developing member) 25. The developing roller 25 uses the developer (hereinafter, referred to as a toner) to develop the latent image.

Each of the photosensitive drum 2 and the developing cartridges 5*a* to 5*d* is configured as a cartridge mountable to and detachable from an apparatus main body A. Specifically, the photosensitive drum 2 is provided in the process cartridge 30 mountable to and detachable from the apparatus main body A. The developing devices are the developing cartridges 5 (5*a* to 5*d*) mountable to and detachable from the apparatus main body A. Each of the cartridges 5 is mounted detachably to the apparatus main body A in an independent manner by an operator (user) In this first embodiment, the process cartridge 30 includes the charging roller (charging member) 3, the cleaning device (cleaning member) 6, and a residual developer containing portion 31 for containing the developer removed by the cleaning device 6 in addition to the photosensitive drum 2. Each of the cartridges 5 (5*a* to 5*d*) is mountable to and detachable from the rotatable rotary (rotating support) 1 provided in the apparatus main body A.

The process cartridge is obtained by, for example, integrating the electrophotographic photosensitive member, and at least one of the charging roller 3 and the cleaning device 6 as the process members, into a cartridge. Therefore, as the process cartridge, a cartridge obtained by integrating the electrophotographic photosensitive member, and the charging roller 3 and the cleaning device 6 as the process members, into a cartridge is exemplified. Alternatively, for example, a cartridge obtained by integrating the electrophotographic photosensitive member and the charging roller 3 as the process member into a cartridge is also exemplified.

Figure 2:
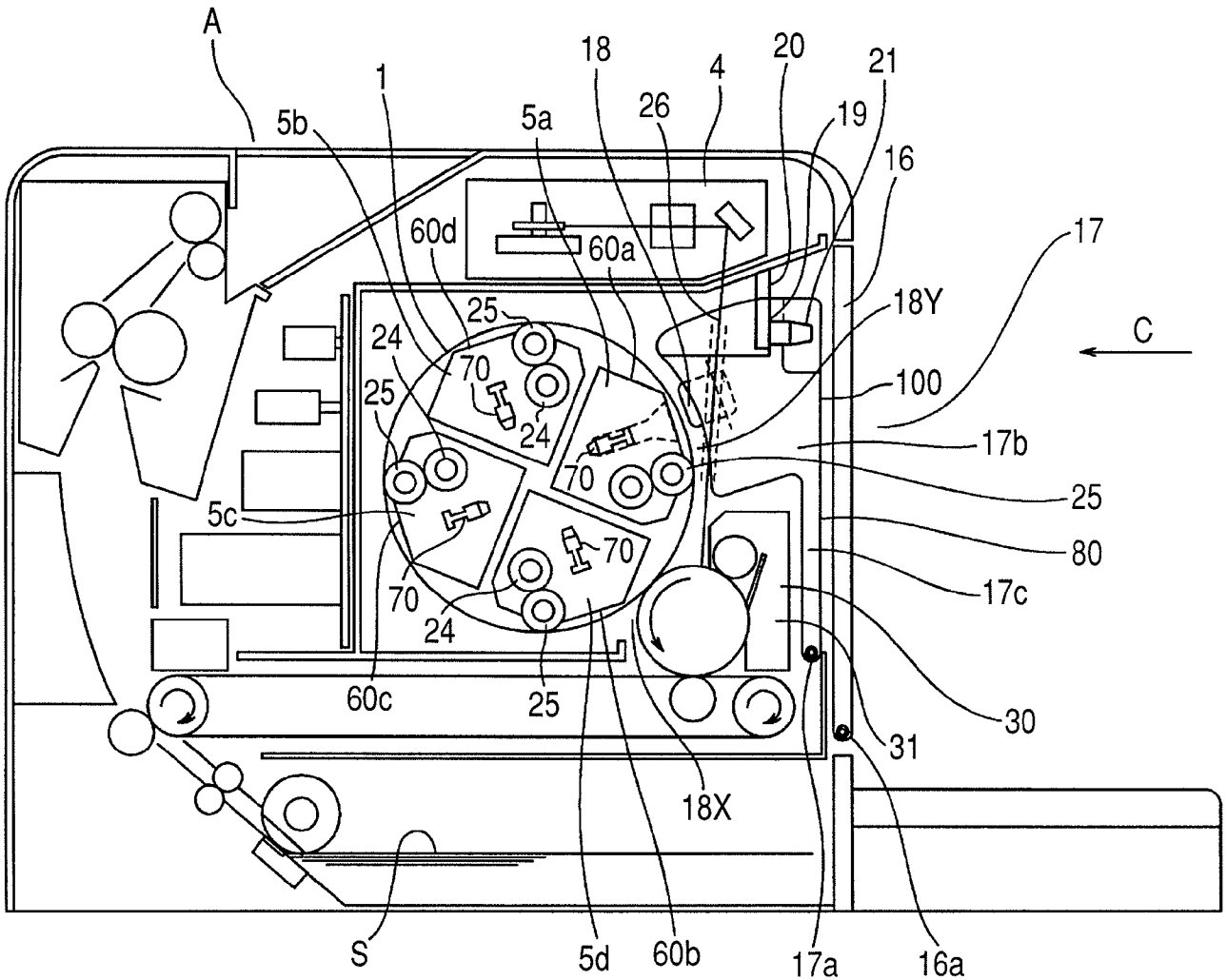
FIG. 2 is a cross-sectional view illustrating a developing cartridge mounting/detaching operation in the color image forming apparatus according to the first embodiment.

For the image formation, the photosensitive drum 2 is rotated in a direction indicated by an arrow (in a counterclockwise direction) in FIG. 2 in synchronization with the rotation of an intermediate transfer belt 7. Then, a surface of the photosensitive drum 2 is uniformly charged by the charging roller 3. Moreover, light is radiated by the exposure means 4 according to a yellow image to form a yellow electrostatic latent image on the photosensitive drum 2

Simultaneously with the formation of the latent image, the rotary 1 is rotated to locate the yellow developing cartridge 5*a* at a developing position 18X. Then, a voltage having the same polarity as that of the charging polarity of the photosensitive drum 2 is applied at substantially the same potential to the developing roller 25 so that the yellow developer adheres to the latent image formed on the photosensitive drum 2. In this manner, the yellow developer adheres to the latent image to develop the latent image. Specifically, it is the developing roller 25 that develops the latent image.

Thereafter, a voltage having the polarity opposite to that of the developer (hereinafter, referred to as a toner) is applied to a primary transfer roller 8 provided inside of the intermediate transfer belt 7. As a result, a yellow toner image (developer image) formed on the photosensitive drum 2 is primarily transferred to the intermediate transfer belt 7.

Similarly, the rotary 1 is rotated to cause the magenta cartridge 5*b*, the cyan cartridge 5*c*, and the black cartridge 5*d* to successively face the photosensitive drum 2. Then, the latent image is developed by each of the cartridges 5*b*, 5*c*, and 5*d*. Then, the developed toner image is transferred to the intermediate transfer belt 7 in an overlapping manner. In this manner, a color image is formed on the intermediate transfer belt 7.

While the toner image is being transferred to the intermediate transfer belt 7, neither a secondary transfer roller 10 nor a cleaning unit 9 for cleaning the intermediate transfer belt 7 is in contact with the intermediate transfer belt 7.

On the other hand, in synchronization with the image forming operation described above, the sheet S as the recording medium is conveyed to an image forming portion by conveying means. In this first embodiment, a plurality of sheets S are contained in a stacked manner in a cassette 11 provided in a lower portion of the apparatus. Then, in synchronization with the image forming operation, each of the sheets S in the cassette 11 is fed in a separated manner by a sheet feeding roller 12. Then, the fed sheet S is sent to a secondary transfer portion between the intermediate transfer belt 7 and the secondary transfer roller 10 by a pair of registration rollers 13. The recording medium is a medium on which the image is formed, and is, for example, a sheet of paper, an OHP sheet or the like.

A voltage having the polarity opposite to that of the toner is applied to the secondary transfer roller 10. The toner images in four colors superimposed on the intermediate transfer belt 7 are secondarily transferred collectively onto the surface of the conveyed sheet S.

Then, the sheet S, onto which the toner image is transferred, is conveyed to a fixing device 14. In the fixing device 14, the sheet S is heated and pressurized to fix the transferred toner image onto the sheet S. As a result, the image is formed on the sheet S. Then, the sheet S is ejected from the fixing device 14 to an ejection part of an upper cover 15 outside of the apparatus.

(Mounting/Detaching Configuration of the Developing Cartridge)

The rotary 1 is provided with a plurality of mounting portions 60 (60*a*, 60*b*, 60*c*, 60*d*) for the cartridges 5. Each of the cartridges 5 (5*a* to 5*d*) containing the developers in different colors is mounted to each of the mounting portions 60, which are provided to the rotating rotary 1 at a plurality of positions. Specifically, each of the cartridges 5 is detachably mounted to the rotary 1 (each of the mounting portions 60). In this first embodiment, each of the cartridges 5 is held by holding means which can lock the cartridge 5 and release the lock of the cartridge 5. Specifically, each of the cartridges 5 is held by the holding means for releasably locking the cartridge 5. By using the holding means, each of the cartridges 5 is mounted to and detached from the rotary 1 (each of the mounting portions 60).

Next, a configuration for the above-mentioned operation and the mounting/detaching operation are described. The cartridges 5*a*, 5*b*, 5*c*, and 5*d* are detachably mounted respectively to the mounting portions 60*a*, 60*b*, 60*c*, and 60*d* provided to the rotary 1.

Each of the four cartridges 5*a* to 5*d* is detachably mounted to the rotary 1. The four cartridges 5*a* to 5*d* differ from each other only in the color of the toner and have the same configuration. Each of the cartridges 5 includes developing means 61 for developing the latent image formed on the photosensitive drum 2 by using the toner, in a cartridge frame 5*h*. The developing means 61 includes a toner containing portion which contains the toner, a toner feeding roller 24 for feeding the toner contained in the toner containing portion, and the developing roller 25 for feeding the fed toner to the photosensitive drum 2 to develop the latent image with the toner. Specifically, the developing means 61 uses the toner to develop the electrostatic latent image formed on the photosensitive drum 2.

Figure 3:
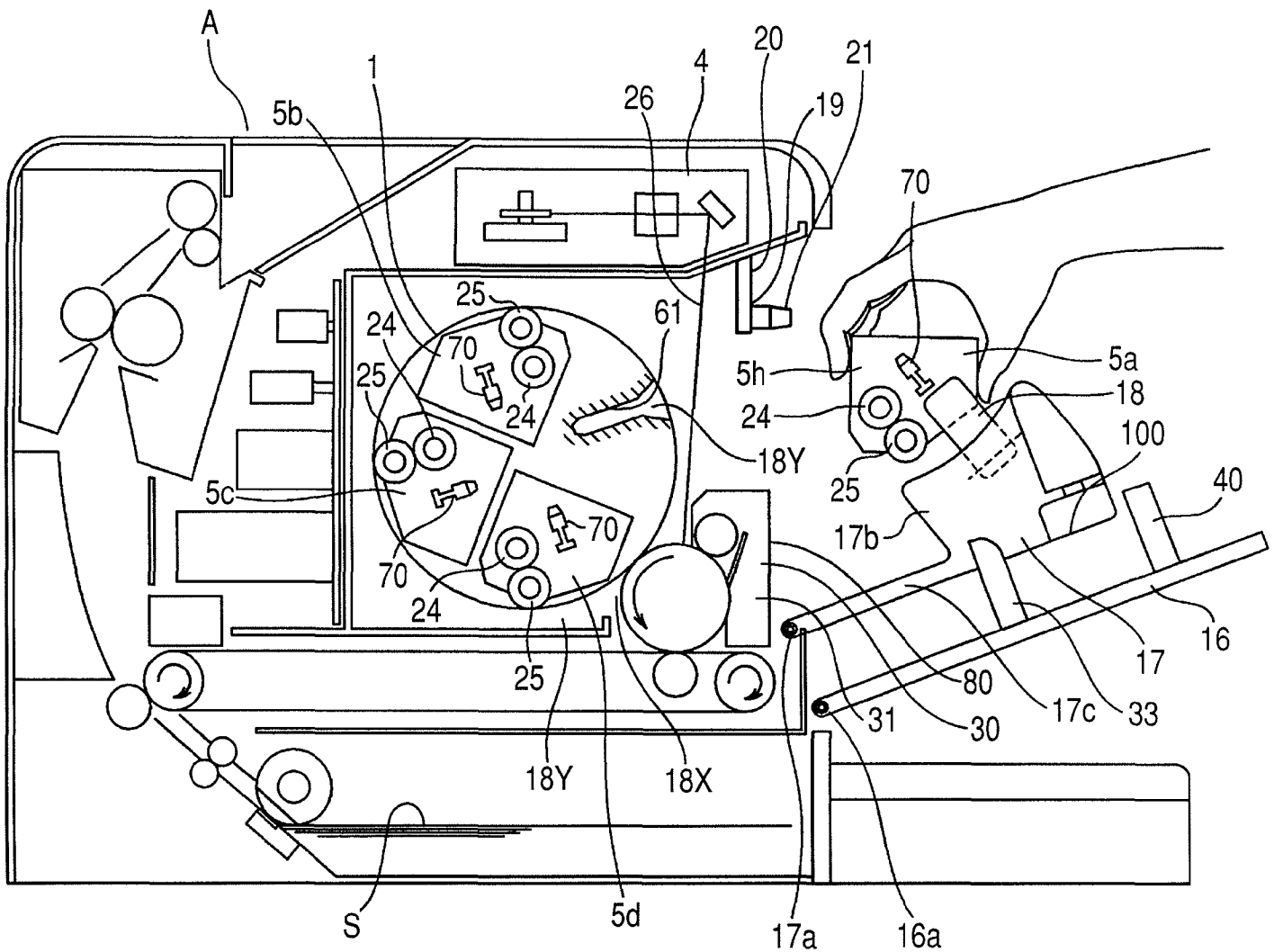
FIG. 3 is another cross-sectional view illustrating the developing cartridge mounting/detaching operation in the color image forming apparatus according to the first embodiment.

Among the cartridges 5*a* to 5*d*, for example, the case where the cartridge 5*a* containing the yellow toner is detached from the rotary 1 (the mounting portion 60*a*) will be described. As illustrated in FIG. 2, by rotating the rotary 1, the cartridge 5*a* is located at a mounting/detaching position 18Y which is different from the developing position 18X. The developing position 18X is a position at which the developing roller 25 is opposed to the photosensitive drum 2 (FIG. 1) Then, the mounting/detaching position 18Y (FIG. 2) is in a phase in which none of the cartridges 5 is present at the developing position 18X. In this state, as illustrated in FIG. 3, the operator opens a cartridge door (openable and closable member) 16 which is opened and closed for mounting/detaching the cartridge. The door 16 is pivotably attached to the apparatus main body A about a supporting point 16*a*.

Inside the door 16, an adapter member (cartridge holding member) 17 serving as the holding means for holding the cartridge 5 is provided. When the operator opens the door, the adapter member 17 is exposed.

(Cartridge Holding Means)

Figure 4:
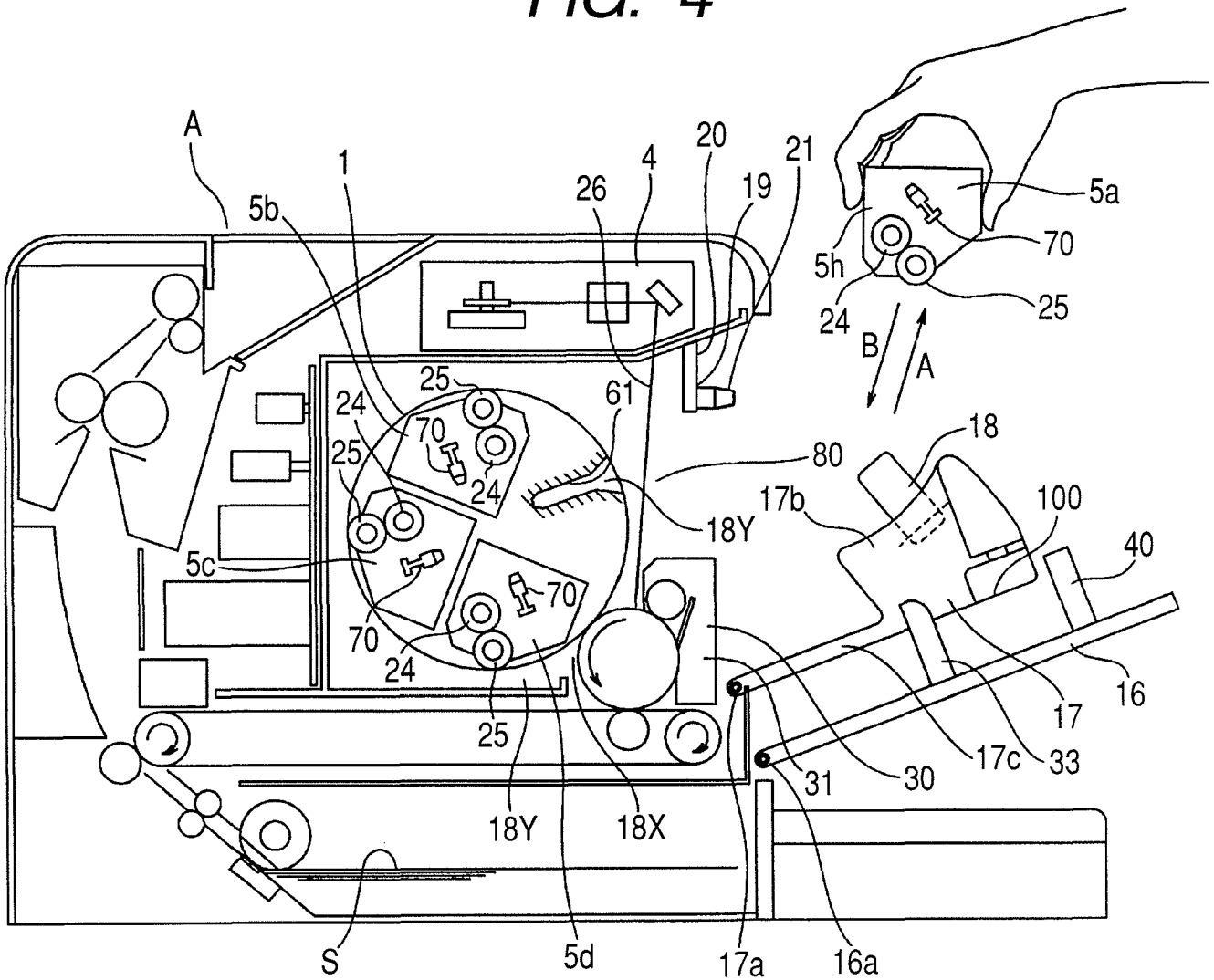
FIG. 4 is still another cross-sectional view illustrating the developing cartridge mounting/detaching operation in the color image forming apparatus according to the first embodiment.

The adapter member 17 includes leg portions 17*c* provided on both longitudinal sides of an adapter portion 17*b* in an integrated manner. An end of each of the leg portions 17*c* is pivotably attached to the apparatus main body A about a supporting point 17*a*. The adapter member 17 locks the cartridge 5*a* to be able to hold the cartridge 5*a*. When the adapter member 17 is opened in the state where the adapter member 17 is holding the cartridge 5*a* as illustrated in FIG. 3, the cartridge 5*a* is moved out of the apparatus main body A with a rotating operation of the adapter member 17. Then, as illustrated in FIG. 4, the lock of the cartridge 5*a* is released from the adapter member 17 to pull out the cartridge 5*a* in a direction indicated by an arrow A. As a result, the cartridge 5*a* alone can be removed from the apparatus main body A. In this operation, the operator opens the door 16. Subsequently, the operator grips a gripper (operating portion) 100 provided to an upper portion of the adapter member 17 to pivot the adapter member 17 to the outside of the apparatus main body A. The operator also grips the gripper (operating portion) 100 to pivot the adapter member 17 to the inside of the apparatus main body A.

Next, a configuration for allowing the adapter member 17 to lock and hold the cartridge 5 and a configuration for releasing the lock are described.

Figure 5:
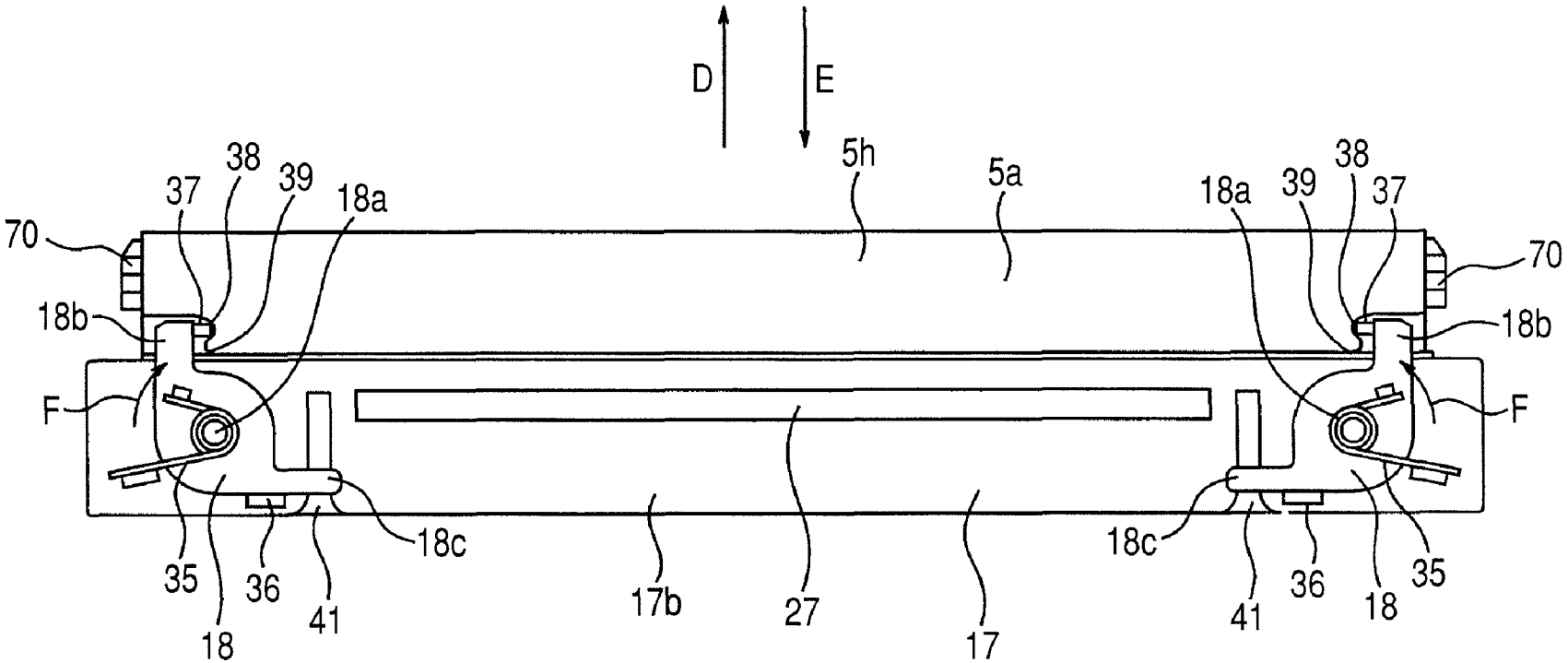
FIG. 5 is an explanatory cross-sectional view illustrating a state where a developing cartridge is locked to an adapter member and a cartridge door is in an open state.

FIG. 5 is an explanatory cross-sectional view illustrating a state where the cartridge 5*a* is locked to the adapter member 17. In this illustrated state, the door 16 is opened.

As illustrated in FIG. 5, a lock member 18 is provided pivotably about a supporting point 18*a* for each of both longitudinal ends of the adapter portion 17*b* of the adapter member (cartridge holding member) 17 Each of the lock members 18 is biased by a biasing member (elastic member) 35 consisting of a helical torsion coil spring in a direction indicated by each arrow F in FIG. 5. The rotation of the lock member 18 is limited by a stopper 36 integrally formed with the adapter member 17.

On the other hand, a recess (first locked portion) 37, in which the lock member 18 is locked, is provided in the cartridge 5*a*. A lock pin 38 integrally formed with the lock member 18 is locked in the recess 37. While the lock pin 38 is being locked in the recess 37, the cartridge 5*a* is held by the adapter member 17 by a biasing force (elastic force) of the biasing member 35. Specifically, the cartridge 5*a* is locked to the adapter member 17. The lock member 18 releasably locks the cartridge 5 to the adapter member (cartridge holding member) 17. The adapter member 17 also holds the cartridge 5 to move the cartridge 5 to the mounting portion 60. The recess 37 is provided in each of both longitudinal ends of the frame 5*h* of the cartridge 5. Similarly, the lock member 18 is provided to each of both longitudinal ends of the adapter member 17.

As illustrated in FIG. 3, when the adapter member 17 is pivoted while the adapter member 17 is holding the cartridge 5*a*, the lock state between the lock pin 38 and the recess 37 is maintained by the biasing force of the biasing means 35. The biasing force of the biasing means 35 is set to prevent the cartridge 5*a* from falling out of the adapter member 17. On the other hand, as illustrated in FIG. 4, when the operator pulls the cartridge 5*a* out of the locked adapter member 17 (in a direction indicated with an arrow D in FIG. 5), the biasing force of the biasing member 35 is set to cause the lock pin 38 against the biasing force (elastic force) to run upon a slope 39 of the recess 37 to release the lock. In this manner, the cartridge 5*a* can be independently pulled out of the adapter member 17 (the apparatus main body A). The operator moves the cartridge 5*a* in a direction indicated by an arrow E (FIG. 5) to set the cartridge 5*a* to the adapter member 17. As a result, the lock pin 38 is guided again by the slope 39 to lock the lock pin 38 in the recess 37. Specifically, the lock pin 38 is fitted into the recess 37.

The same operation is also performed for other cartridges.

According to this first embodiment, the operator opens the door 16. Subsequently, the operator pivots the adapter member 17 to the outside of the apparatus main body A (FIG. 3). In this state, the operator holds the cartridge 5 with a hand and places the cartridge 5*a* from a direction indicated by an arrow B (FIG. 4) at a predetermined position of the adapter member 17. As a result, the lock pin 38 provided on one longitudinal end of the adapter member 17 is fitted into the recess 37 provided in one longitudinal end of the cartridge 5. Similarly, the lock pin 38 provided on another longitudinal end of the adapter member 17 is fitted into the recess 37 provided on another longitudinal end of the cartridge 5. Then, by the biasing force of the biasing member 35, the state where the lock pins 38 are fitted into (locked to) the recesses 37 is maintained. In this state, the operator closes the door 16. Subsequently, the operator pivots the adapter member 17 to the inside of the apparatus main body A (FIG. 3). As a result, the cartridges 5 are positioned in the mounting portions 60 (60*a* to 60*d*) provided to the rotary 1.

For detaching the cartridge 5 from the adapter member 17, the operator rotates the lock members 18 provided to both ends in directions opposite to the directions indicated by the arrows F (FIG. 5) As a result, the lock pins 38 are removed from the recesses 37. Thereafter, the operator pulls out the cartridge 5 with a hand in the direction indicated by the arrow A (FIG. 4). The lock member 18 is rotated against the biasing force of the biasing member 35.

As described above, the adapter member (cartridge holding member) 17 holds the cartridge 5 to move the cartridge 5 to the mounting portion 60. The adapter member 17 assumes an outside position (position illustrated in FIGS. 3 and 4) situated outside of an opening portion 80 to hold the cartridge 5 and an inside position (position illustrated in FIGS. 1 and 2) situated inside of the opening portion 80 to move the cartridge held by the adapter member 17 to the mounting portion 60. In a second embodiment of the present invention described below, the outside position corresponds to positions illustrated in FIGS. 10, 12, and 13, whereas the inside position corresponds to positions illustrated in FIGS. 14 and 15.

The cartridge 5 in this first embodiment is mounted to the rotary 1. Specifically, this embodiment describes the rotary developing device. Therefore, as described above, after the cartridge held by the adapter member 17 is mounted to the rotary 1, it is necessary to release the lock state between the cartridge 5*a* and the adapter member 17 to rotate the rotary 1.

Figure 6:
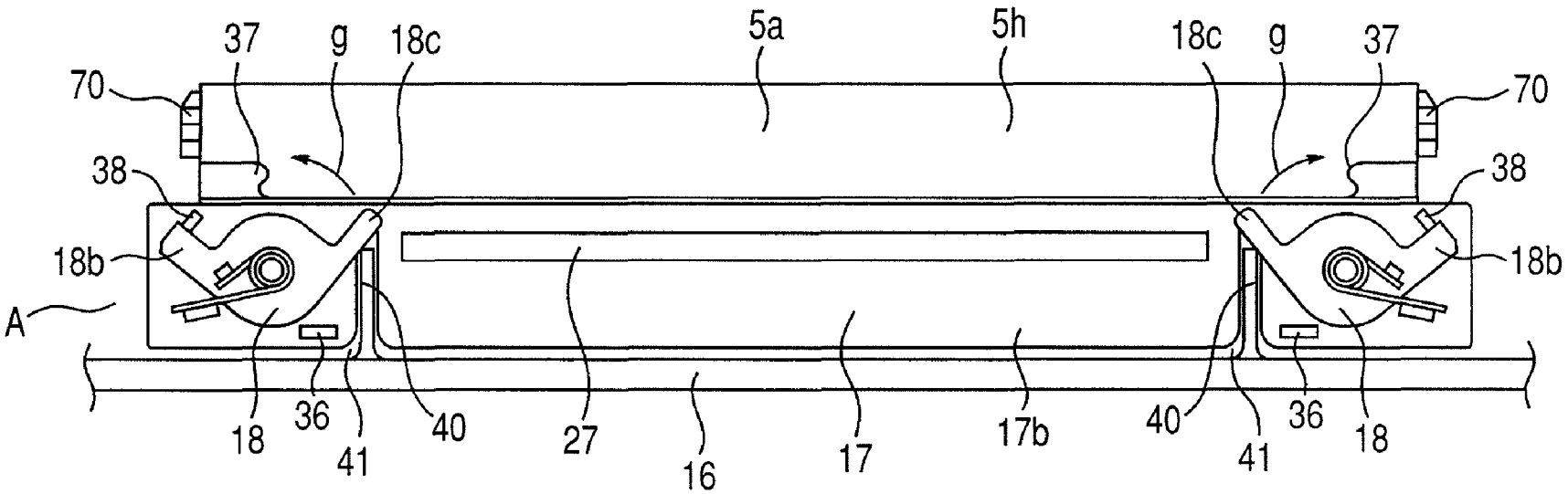
FIG. 6 is an explanatory cross-sectional view illustrating a state where the lock of the developing cartridge to the adapter member is released.

For this reason, in this embodiment, switching means for switching the lock state and the lock release state of the cartridge 5*a* by the adapter member 17 is provided. A configuration of the switching is described referring to FIG. 6. FIG. 6 is an explanatory cross-sectional view illustrating a state where the lock of the cartridge 5*a* to the adapter member 17 is released. In the state illustrated in FIG. 6, the door 16 is closed with respect to the apparatus main body A.

As illustrated in FIGS. 5 and 6, for each of the lock members 18 provided to the adapter member 17, arm portions 18*b* and 18*c* are provided at an angle of approximately 90 degrees in a protruding manner. The lock pin 38 is provided to the arm portion 18*b*, whereas a slit (space portion) 41 is provided in the adapter member 17 to face the arm portion 18*c*.

As illustrated in FIG. 6, abutment ribs (lock releasing members) 40 constituting the switching means are provided on an inner face of the door 16. The abutment ribs 40 are provided at the locations to be inserted into the slits 41 when the door 16 is closed.

As described above, by closing the adapter member 17, the cartridge 5*a* gets to a predetermined position of the mounting portion 60 while guides 70 are guided by guides 61. Specifically, the cartridge 5*a* is mounted to the mounting portion 60. Then, the cartridge 5*a* is locked by a lock member 28 described below to be positioned at the predetermined position of the mounting portion 60.

Further, as described above, by closing the door 16, the lock members 18 are pushed by the abutment ribs 40 to be rotated in directions indicated by arrows g (FIG. 6). As a result, the lock pins 38 are removed from the recesses 37.

Specifically, the cartridge 5 is mounted to the mounting portion 60 provided to the rotary 1 while being locked to the adapter member 17. When the operator closes the door 16 in this state, the lock state of the cartridge 5 to the adapter member 17 is released. The abutment ribs (lock releasing members) 40 release the lock of the cartridge 5 to the adapter member 17 by the lock members 18 after the adapter member 17 moves the cartridge 5 to the mounting portion 60. The abutment ribs 40 are provided on the inner side of the door 16.

Therefore, while the cartridge 5*a* is being held by the adapter member 17, the cartridge 5*a* is mounted to the mounting portion 60*a* provided to the rotary 1. Next, when the operator closes the door 16, the abutment ribs 40 are fitted into the slits 41. As a result, the lock members 18 are rotated in the directions indicated by the arrows g (FIG. 6) against the biasing force of the biasing members 35. As a result, the lock members 18 release the lock to the cartridge 5*a*. The lock members 18 are located to avoid a rotational trajectory of the rotary 1. Cartridge-side guides 70, which are provided to mount the cartridge 5*a* into the mounting portion 60*a*, are fitted into main body-side guides 61. In this case, the guides 70 are respectively provided to both longitudinal ends of the frame 5*h* of the cartridge 5*a*, whereas the guides 61 are respectively provided to both longitudinal ends of the rotary 1. The guides 70 protrude from the frame 5*h*. The guides 61 are formed as grooves.

(Cartridge Lock Means)

For the rotary type developing apparatus, in order to allow the rotation of the rotary 1 to which the cartridge 5 is mounted, it is necessary to prevent the cartridge 5 mounted to the rotary 1 from being removed from the rotary 1. Therefore, in this embodiment, cartridge lock means for enabling the lock and the lock release of the cartridge 5 mounted to the rotary 1 to the rotary 1 is provided. Specifically, the cartridge lock means releasably locks the cartridge 5 to the rotary 1.

Figure 7:
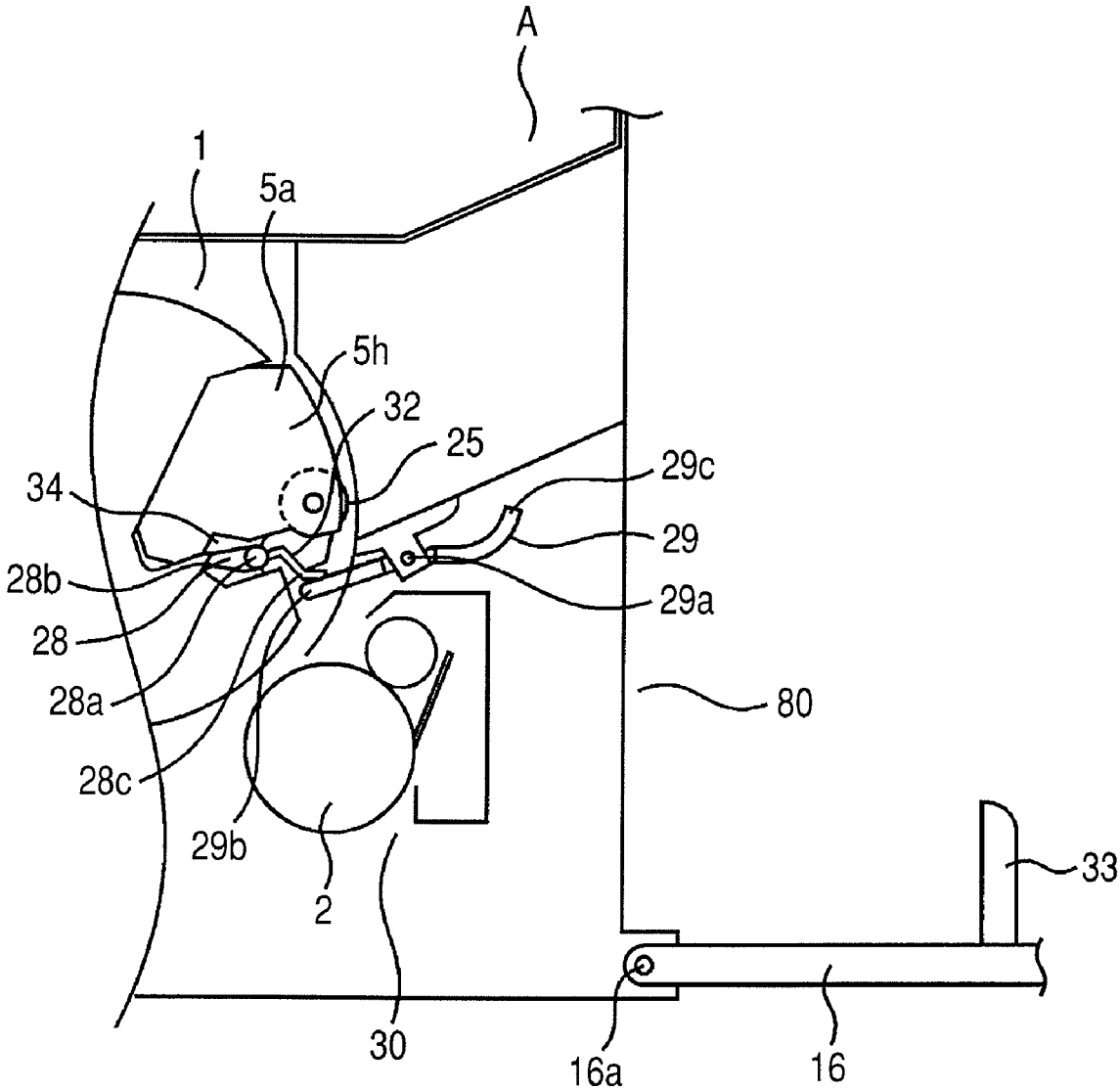
FIG. 7 is an explanatory cross-sectional view illustrating a state where the cartridge door is in an open state and the lock of the developing cartridge to a rotary is released.
Figure 8:
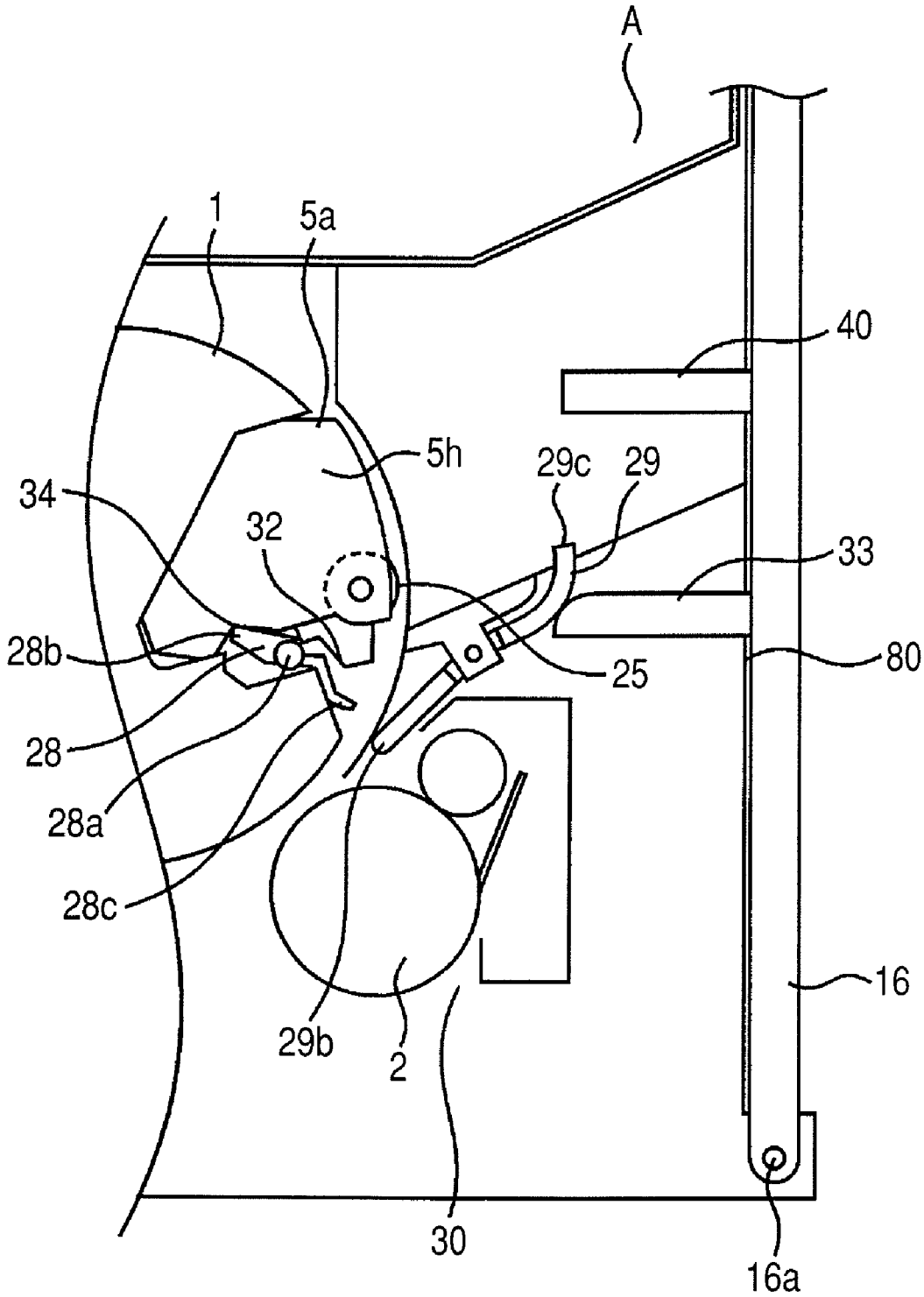
FIG. 8 is an explanatory cross-sectional view illustrating a state where the cartridge door is in a closed state with respect to an apparatus main body and the developing cartridge is locked to the rotary.

Next, referring to FIGS. 7 and 8, a configuration of the cartridge lock means is described. Note that, in FIGS. 7 and 8, the adapter member 17 is not illustrated for convenience.

FIG. 7 is an explanatory cross-sectional view illustrating a state where the lock of the cartridge 5 to the rotary 1 is released and the door 16 is opened.

As illustrated in FIG. 7, a lock member 28 is provided to the rotary 1 to be pivotably about a supporting point 28*a*. On the lock member 28, a bias moment (elastic force) acts in a clockwise direction in FIG. 7 by biasing means (not shown).

Further, a link member 29 is provided to the apparatus main body A to be pivotably about a supporting point 29*a*. Even on the link member 29, a bias moment (elastic force) acts in the clockwise direction by biasing means (not shown). The bias moment acting on the link member 29 is set to be surely larger than that acting on the lock member 28. Each of the lock member 28 and the link member 29 is provided on one end or each of both ends in a direction orthogonal to a direction in which the cartridge 5 is inserted into the apparatus main body A.

Then, one end 29*b* of the link member 29 is linked to the lock member 28 to push up one end 28*c* of the lock member 28. Therefore, in the state illustrated in FIG. 7, the link member 29 pushes up the end 28*c* of the lock member 28. As a result, the lock member 28 is rotated in a counterclockwise direction. The rotary 1 is provided with a rotation regulating portion 32. The lock member 28 rotating in the counterclockwise direction comes into contact with the rotation regulating portion 32 to stop the rotation of the lock member 28. Specifically, the rotation of the lock member 28 is regulated by the rotation regulating portion 32.

As described above, in the state where the lock member (mounting portion locking member) 28 is in contact with the rotation regulating portion 32, one end 28*b* of the lock member 28 is located not to interfere with the cartridge 5*a*. Specifically, the one end 28*b* is disengaged from a lock-engaging portion 34 provided in a lower portion of the frame 5*h* of the cartridge 5*a*. At this time, the lock member 28 is in a lock release state. Therefore, when the door 16 is in an open state, the cartridge 5*a* can be freely mounted to and detached from the rotary 1.

On the other hand, FIG. 8 is an explanatory cross-sectional view illustrating a state where the cartridge 5*a* is locked to the rotary 1 and the door 16 is closed with respect to the apparatus main body A.

In this embodiment, the lock state and the lock release state of the lock member 28 are constituted to be switched by the switching means (releasing member). For this purpose, a rib (mounting portion lock releasing member) 33 constituting the switching means is provided to the door 16. As illustrated in FIG. 8, the rib 33 presses the end 29*c* of the link member 29, when the door 16 is closed, to rotate the link member 29 in a counterclockwise direction.

With the rotation of the link member 29, the link member 29 gets out of contact with the lock member 28. Simultaneously, the lock member 28 is rotated in the clockwise direction by biasing means (not shown). Then, the end 28*b* of the lock member 28 is locked in a space of the lock-engaging portion (second locked portion; concave portion) 34 provided in the cartridge 5*a* mounted to the mounting portion 60*a*. In this state, the cartridge 5*a* is locked to the mounting portion 60*a* of the rotary 1 and is prevented from being released from the mounting portion 60*a*. As a result, when the door 16 is in the closed state, the cartridge 5*a* is fixed to the rotary 1.

As described above, the lock member (mounting portion locking member) 28 locks the cartridge 5 releasably to the mounting portion 60. When the cartridge 5 is to be removed from the mounting portion 60, the rib (mounting portion lock releasing member) 33 releases the lock of the cartridge 5 to the mounting portion 60 by the lock member 28. In this embodiment, although the rib 33 is provided on the inner side of the door 16, the position of the rib 33 is not limited thereto. However, when the rib 33 is provided on the inner side of the door 16 as in this embodiment, the lock of the cartridge 5 to the mounting portion 60 can be released by closing the door 16. Therefore, the operability is improved.

When the door 16 is opened, the rib (mounting portion lock releasing member) 33 releases the lock of the cartridge 5 to the mounting portion 60 by the lock member (mounting portion locking member) 28. The rib 33 is provided on the inner side of the door 16.

(Positioning of the Adapter Member)

As described above, the cartridge 5*a* is mounted to the apparatus main body A while being held by the adapter member 17. Specifically, when the cartridge 5*a* is set to the adapter member 17 in the open state, the cartridge 5*a* is fixed and held to the adapter member 17 by the lock member 18 (see a transition from FIG. 4 to FIG. 3). In this state, when the adapter member 17 is closed with respect to the apparatus main body A, the cartridge 5*a* moves to a predetermined position in the rotary 1 (see FIG. 2). In this operation, the adapter member 17 is positioned in the apparatus main body A.

Figure 9:
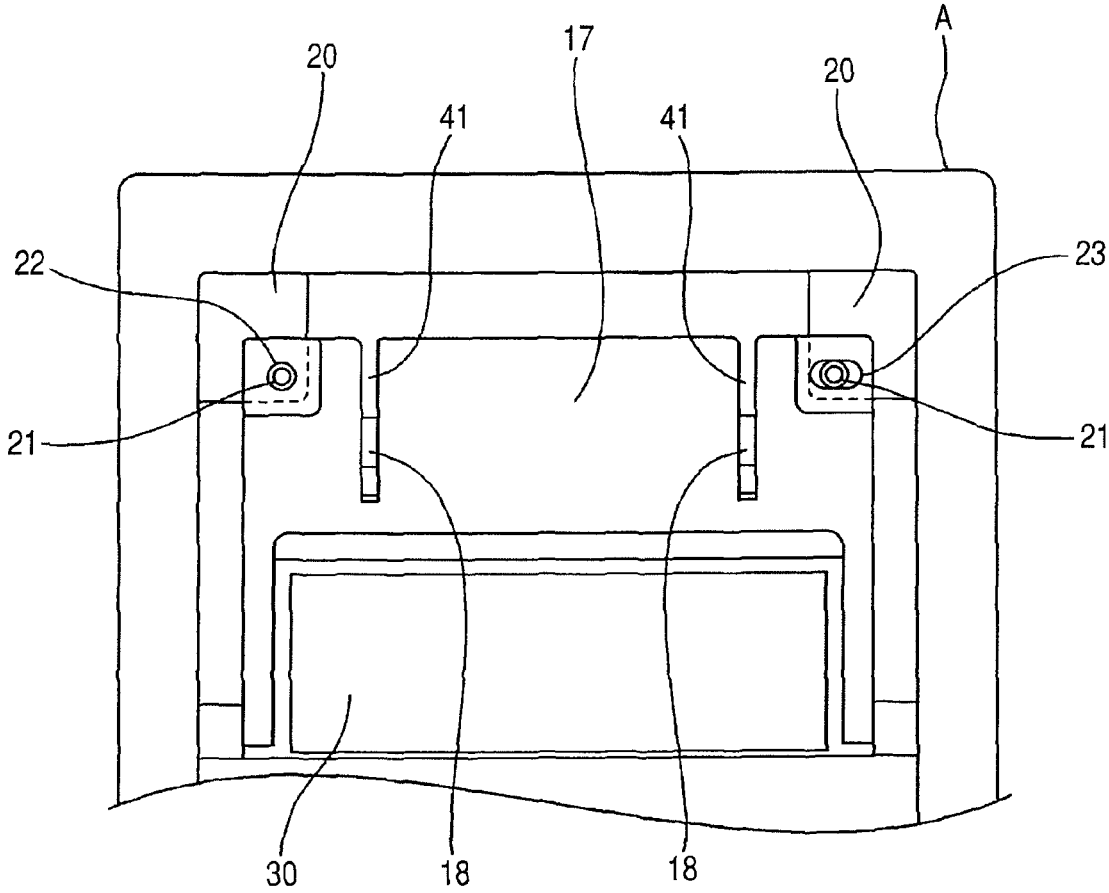
FIG. 9 is an explanatory view illustrating the positioning of the adapter member with respect to the apparatus main body.

A configuration of positioning the adapter member 17 will now be described. FIG. 9 is an explanatory view illustrating a configuration for positioning the adapter member 17 with respect to the apparatus main body A, and is viewed from an arrow C in FIG. 2. For convenience, the door 16 is not illustrated in FIG. 9.

An adapter positioning portion 19 (FIGS. 2 to 4) provided to the apparatus main body A includes abutment faces 20 and positioning bosses 21 provided to the apparatus main body A. When the adapter member 17 is closed, the adapter member 17 comes into contact with the abutment faces 20. At the same time, the bosses 21 are fitted into a hole 22 and a horizontally elongated hole 23 respectively corresponding to the bosses 21, which are provided to the adapter member 17. The adapter member 17 exerts a biasing force on the abutment faces 20 by biasing means (not shown).

As a result, the closed adapter member 17 is positioned in the apparatus main body A. Then, it is ensured that the cartridge 5*a* held by the adapter member 17 is inserted into the mounting portion 60*a* of the rotary 1.

Then, by closing the door 16, the cartridge 5*a* is locked to the rotary 1 (mounting portion 60*a*) in association with the door closing operation, as described above. At the same time, the lock members 18 release the lock to the cartridge 5*a* and are retracted into the adapter member 17. As a result, for the image formation with development switching, the rotary 1 can rotate without interfering with the adapter member 17 and the lock members 18. In this manner, the rotary 1 can operate smoothly.

As described above, the adapter member 17 includes the lock members 18 for locking the cartridge 5*a*. Then, the lock members 18 can assume a position which allows the cartridge 5*a* to be locked to the adapter member 17 when the cartridge 5*a* is mounted to and detached from the apparatus main body A and a position which allows the lock to the cartridge 5*a* to be released when the cartridge 5*a* is mounted to the mounting portion 60*a*.

Figure 10:
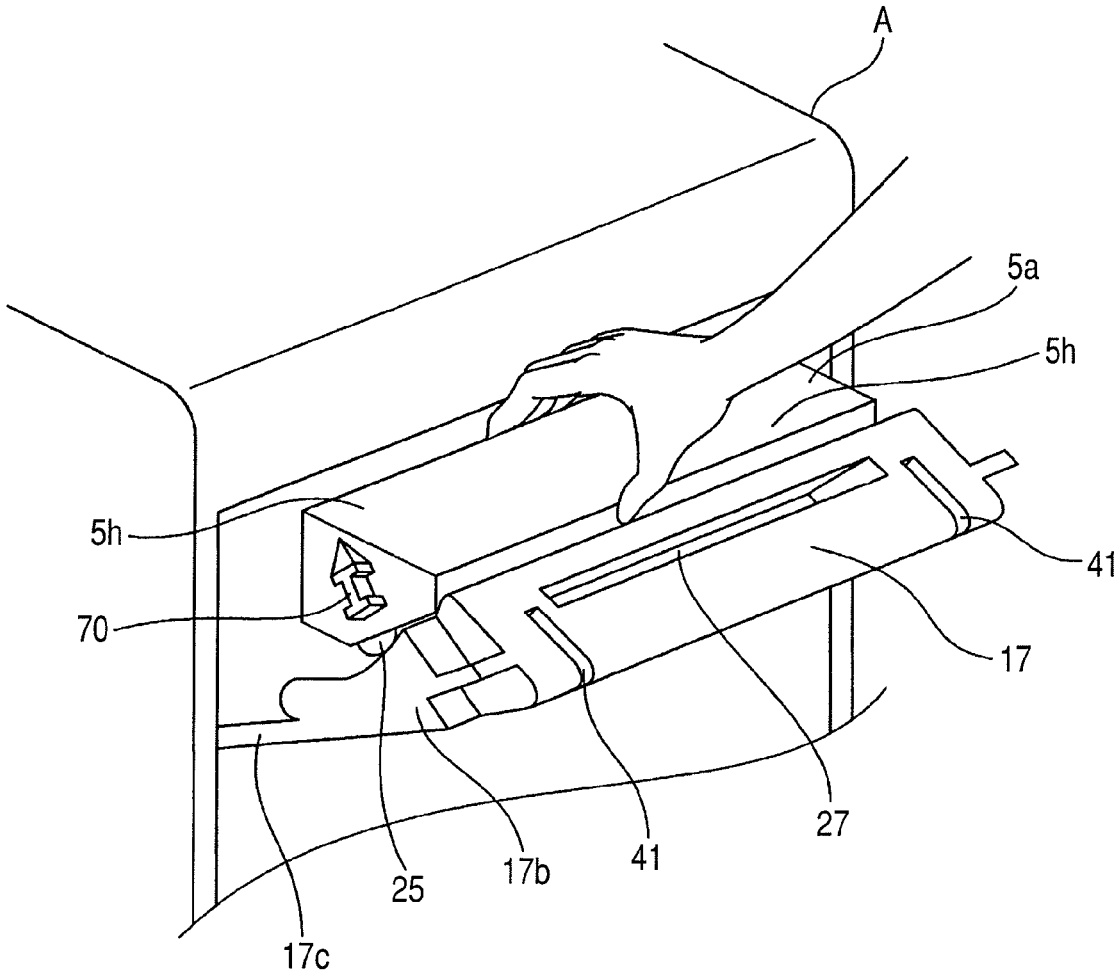
FIG. 10 is an explanatory perspective view illustrating a state where the adapter member holds the developing cartridge.

During the image forming operation, a space for allowing a laser beam path 26 (see FIG. 1) to get to the surface of the photosensitive drum 2 is required. FIG. 10 is a perspective view illustrating a state where the adapter member 17 holds the cartridge 5*a*. A hole portion 27 is provided in the adapter member 17. In the state where the adapter member 17 is housed within the apparatus main body A, a laser beam passes through the hole portion 27. With this structure, the adapter member 17 does not obstruct the laser beam path 26.

As described above, the configuration according to this first embodiment can facilitate the mounting/detachment of the cartridge in the image forming apparatus of the rotary developing type.

In this first embodiment, the process cartridge 30 including the photosensitive drum 2, the charging roller 3, and the cleaning device 6 is also mountable to and detachable from the apparatus main body A. Specifically, the process cartridge 30 is detachably mounted to the apparatus main body A. Then, even in the state where the process cartridge 30 is mounted to the apparatus main body A, the cartridge 5 can be mounted or detached. Any of the cartridges 5*a* to 5*d* and the process cartridge 30 can be mounted and detached from the front side of the apparatus main body A. Specifically, the cartridges 5*a* to 5*d* and the process cartridge 30 are all mountable to and detachable from the apparatus main body A from the side where the door 16 is provided. Specifically, through the opening portion 80 which is opened by the outward pivot of the door 16, the cartridges 5*a* to 5*d* and the process cartridge 30 can all be mounted to and detached from the apparatus main body A.

As described above, the cartridge 5 passes through the opening portion 80 when the cartridge 5 is mounted to the apparatus main body A (mounting portion 60) and is detached from the apparatus main body A. The door (openable and closable member) 16 closes the opening portion 80 in an openable manner.

Second Embodiment

Next, an image forming apparatus according to a second embodiment will be described referring to FIGS. 11 to 14. Since a basic configuration of the apparatus according to this second embodiment is the same as that in the first embodiment described above, the overlapping description thereof is herein omitted and only a configuration which characterizes this second embodiment is described. The members having the same functions as those in the first embodiment described above are denoted by the same reference numerals.

In the first embodiment described above, the example where the adapter member 17 is pivotably mounted to the apparatus main body A has been described However, as in the following second embodiment, the adapter member may be separated from the apparatus main body to be constituted as an independent member.

Figure 11:
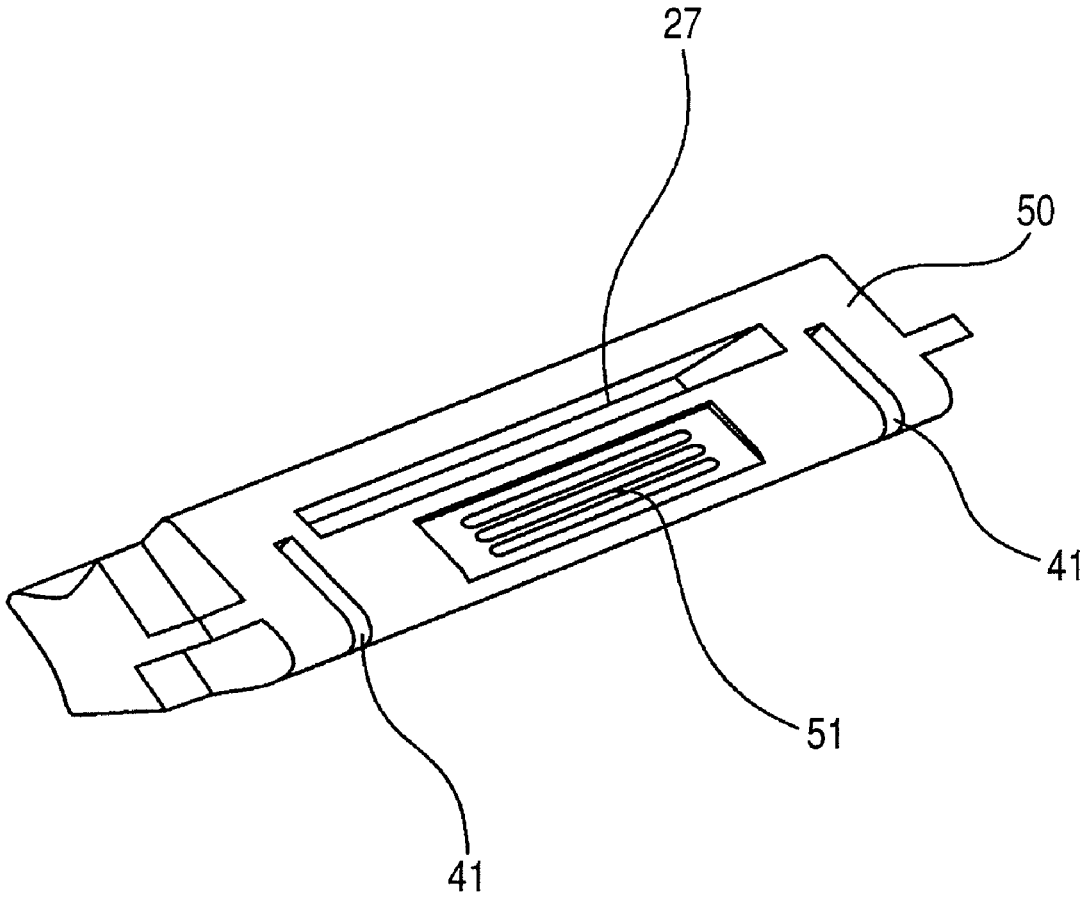
FIG. 11 is an explanatory perspective view illustrating an adapter member according to a second embodiment.
Figure 12:
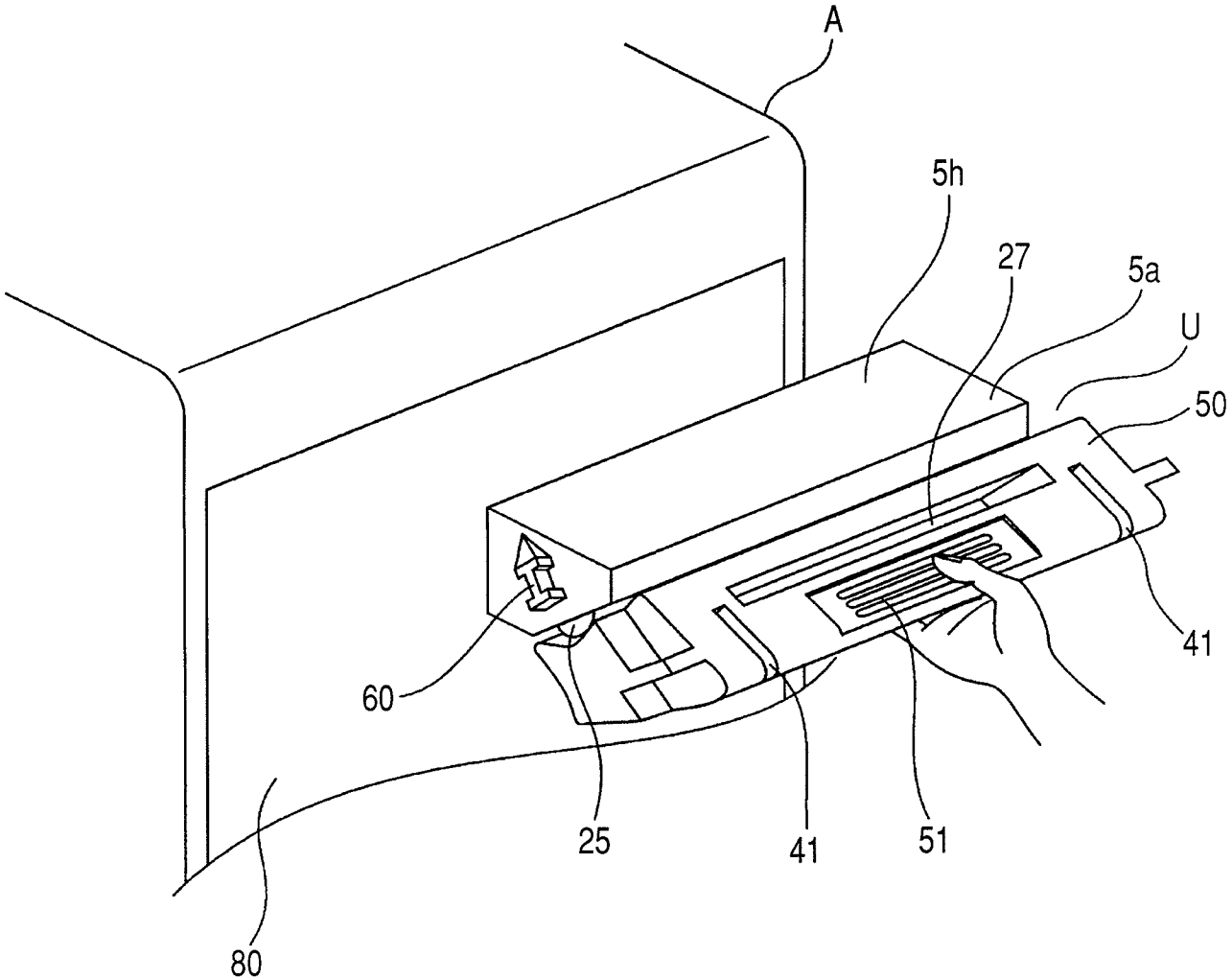
FIG. 12 is an explanatory perspective view illustrating a state where a user grips the adapter member which holds the developing cartridge according to the second embodiment.
Figure 13:
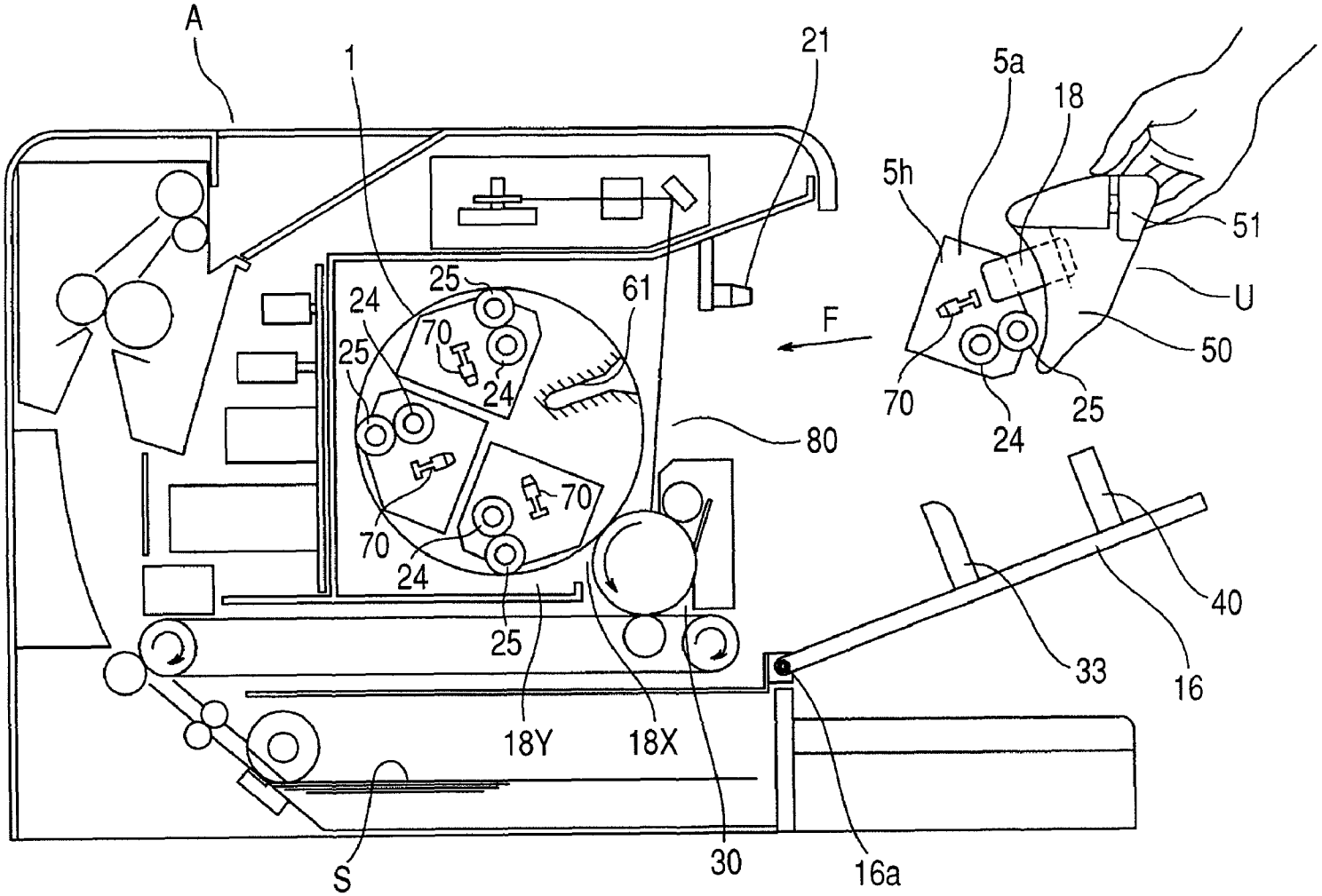
FIG. 13 is a cross-sectional view illustrating a developing cartridge mounting/detaching operation in the color image forming apparatus according to the second embodiment.
Figure 14:
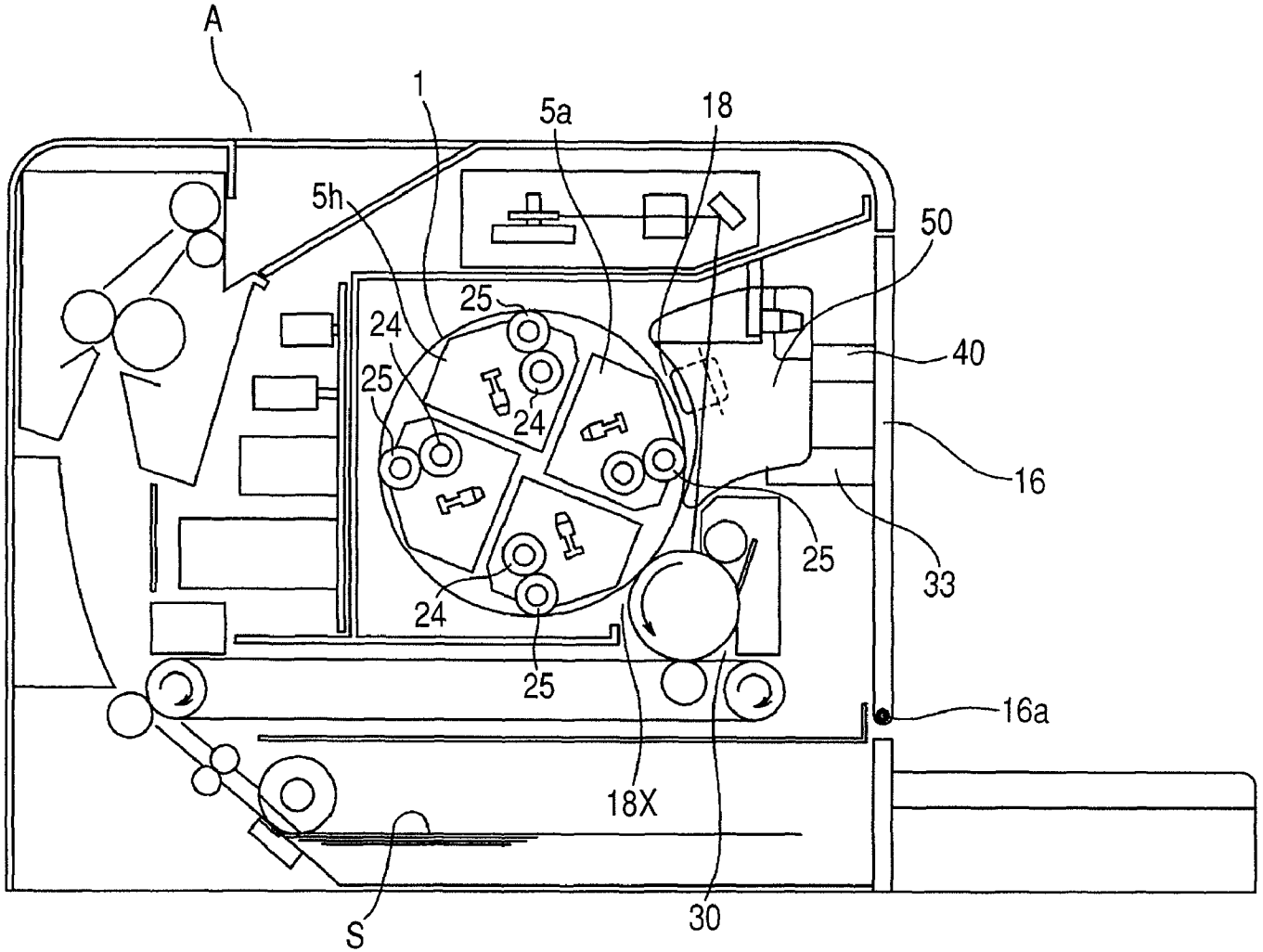
FIG. 14 is another cross-sectional view illustrating the developing cartridge mounting/detaching operation in the color image forming apparatus according to the second embodiment.
Figure 15:
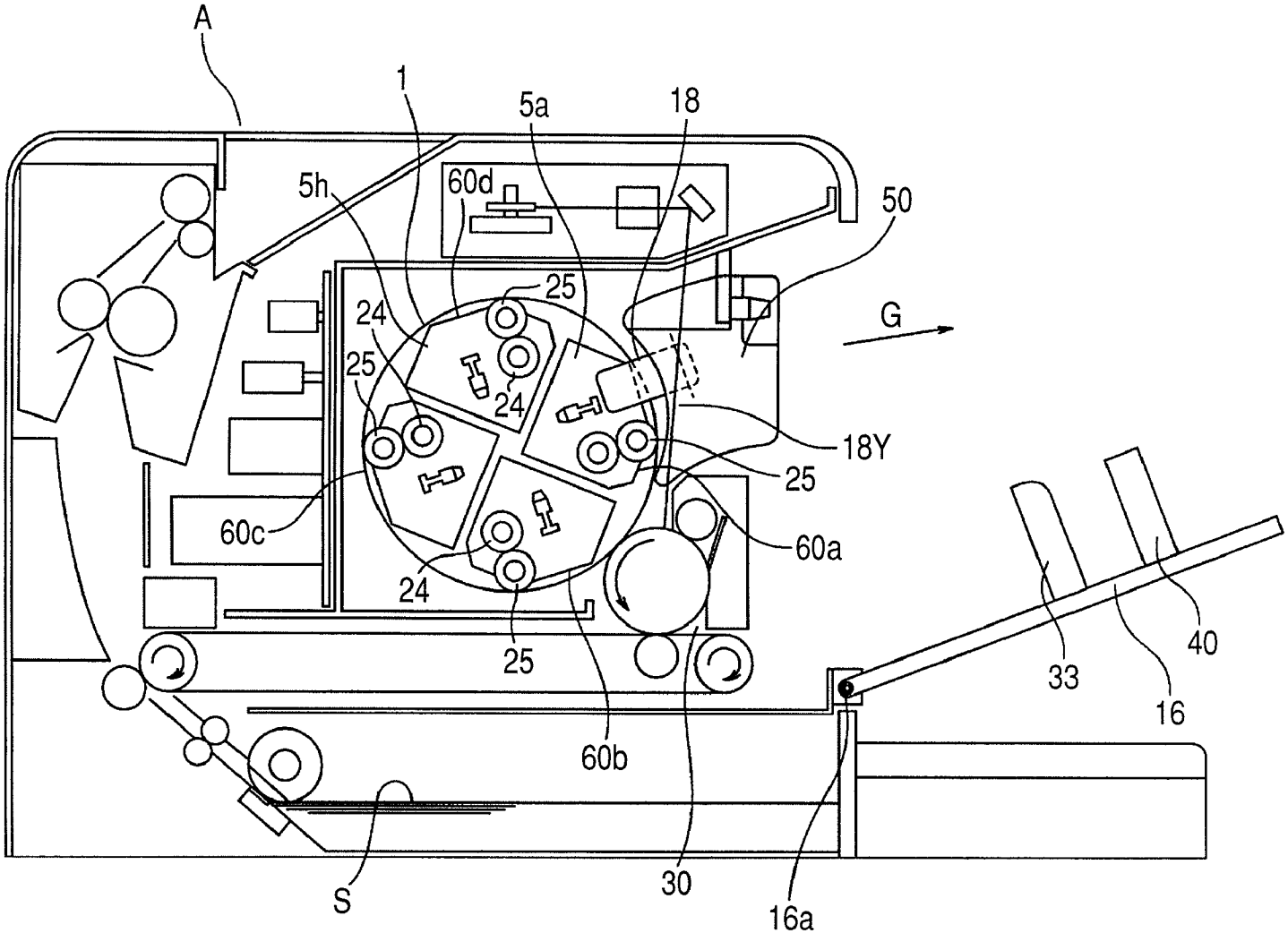
FIG. 15 is still another cross-sectional view illustrating the developing cartridge mounting/detaching operation in the color image forming apparatus according to the second embodiment.

FIG. 11 is an explanatory perspective view illustrating an adapter member 50 according to the second embodiment. FIGS. 12 to 14 are explanatory views, each illustrating a state where a cartridge unit which holds the developing cartridge is mounted to the apparatus main body by the adapter member according to this second embodiment.

(Adapter Member)

The adapter member (cartridge holding member) 50 according to this second embodiment is obtained by omitting the leg portions 17*c* from the adapter member 17 in the first embodiment and therefore corresponds to the adapter portion 17*b* alone.

As illustrated in FIGS. 11 and 12, the adapter member 50 is provided with a gripper (operating portion) 51 to be gripped by the operator for mounting/detaching the developing cartridge 5 to/from the apparatus main body A. As in the case of the adapter member 17 in the first embodiment, the lock members 18 (see FIG. 5) for releasably locking the cartridge 5 are provided on both longitudinal sides of the gripper 51. The lock members 18 are biased by the biasing means 35. The lock members 18 are not illustrated in FIGS. 11 and 12. In this second embodiment, a lock configuration by the lock members 18 is the same as that illustrated in FIG. 5.

On both longitudinal end parts of the gripper 51, the slits 41, into which the abutment ribs 40 provided to the door 16 are inserted to bring the lock state of the lock members 18 into the lock release state, are provided.

Other configurations such as the configuration of the developing cartridge and the lock mechanism are the same as those in the first embodiment described above.

The adapter member 50 in the second embodiment is locked to the cartridge 5*a* by the lock members 18 to be treated as a cartridge unit U. When the adapter member 50 and the cartridge 5*a* are integrated into one unit, the adapter member 50 covers a surface of the developing roller 25, as illustrated in FIG. 12. This configuration prevents the operator from carelessly touching the developing roller 25 when the operator pulls out the cartridge 5*a*.

For mounting the cartridge unit U to the apparatus main body A, the following operation is performed. First, the operator grippes the gripper 51. Then, the operator mounts the cartridge unit U in a direction indicated by an arrow F while the cartridge 5*a* is being held by the adapter member 50. At this time, the cartridge 5*a*, the adapter member 50, and the guides 70 are inserted along the guides 61 provided to the apparatus main body A (rotary 1). Then, the cartridge unit U can be housed in the apparatus main body A.

Then, after the cartridge 5*a* is inserted into the mounting portion 60*a* of the rotary 1 and the adapter member 50 is housed in the apparatus main body A, the operator closes the door 16, as illustrated in FIG. 14. By closing the door 16, the lock of the cartridge 5*a* to the adapter member 50 is released by the ribs 40 and 33 provided to the door 16, as in the first embodiment described above. On the other hand, the cartridge 5*a* is locked to the apparatus main body A (rotary 1) by the lock means.

For removing the cartridge 5 from the apparatus main body A (rotary 1), the operator can easily pull out the cartridge 5 in a direction indicated by an arrow G while gripping the adapter member 50 with the door 16 being opened. When the door 16 is in the open state, the cartridge 5 and the adapter member 50 are locked to each other.

According to each of the embodiments described above, for mounting the cartridge 5 to the mounting portion 60, the cartridge 5 moves while being locked to the adapter member (cartridge holding member) 17 or 50. The cartridge 5 is moved from the outside of the apparatus main body A to the mounting portion 60 while being locked to the adapter member 17 or 50. Then, the recesses (first locked portions) 37 to be releasably locked to the lock members 18 provided to the adapter member 17 or 50 are provided in the frame 5*h* to lock the cartridge 5 to the adapter member 17 or 50.

According to each of the embodiments described above, the cartridge 5 has the lock-engaging portions (second locked portions; concave portions) 34 to be releasably locked to the lock members (mounting portion locking members) 28 to releasably lock the cartridge 5 to the mounting portion 60. The lock-engaging portions 34 are provided on one and another ends in the longitudinal direction of the frame 5*h*.

The lock state of the recesses (first locked portions) 37 to the lock members 18 is released while the cartridge 5 is being mounted to the mounting portion 60. The lock state of the lock-engaging portions (second locked portions) 34 to the lock members (mount portion lock members) 28 is released when the cartridge 5 is to be detached from the mounting portion 60.

According to each of the embodiments described above, the adapter member 17 or 50 moves the cartridge 5 from the outside of the apparatus main body A to the mounting portion 60 when the cartridge 5 is mounted to the mounting portion 60 by the operation of the operator. For this purpose, the adapter member 17 or 50 includes the lock members 18 to be locked in the recesses 37 provided in the cartridge 5. The adapter member 17 or 50 has the slits (space portions) 41 provided to bring the ribs (lock release members) 40 provided to the apparatus main body A into contact with the lock members 18 to release the lock state by the lock members 18.

Further, the adapter member 17 has the gripper (operating portion) 100 to be used by the operator to operate the adapter member 17 when the adapter member 17 moves the cartridge 5 to the mounting portion 60. The adapter member 50 has the gripper (operating portion) 51 to be used by the operator to operate (carry) the adapter member 50 when the adapter member 50 moves the cartridge 5 to the mounting portion 60. The adapter member 17 has the gripper (operating portion) 100 to be used by the operator to operate (pivot) the adapter member 17 when the adapter member 17 moves the cartridge 5 to the mounting portion 60. The gripper (operating portion) 51 is gripped by the operator for carrying the adapter member 50. The gripper 51 is also gripped by the operator for moving the adapter member 17 rotatably mounted to the apparatus main body A into the apparatus main body A. According to each of the embodiments described above, the use of the adapter member 17 or 50 enables the operator to perform the mounting/detaching operation of the cartridge from the front side of the apparatus. Therefore, for mounting/detaching the cartridge reduced in size to/from the rear portion of the apparatus main body, the operability in mounting and detaching can be improved.

Moreover, according to the embodiments described above, the cartridge and the electrophotographic image forming apparatus can be further reduced in size.

Further, according to the embodiments described above, the developing cartridge can be locked by the holding means to be mounted to the mounting portion. For mounting the cartridge, the cartridge holding member is operated to mount the cartridge while the cartridge is being locked to the cartridge holding member. As a result, the operability in mounting and detaching of the cartridge is improved.

As described above, the present invention is applicable to the process cartridge including integrally the photosensitive drum 2 and the process members (charging roller 3, cleaning device 6 and the like) acting on the photosensitive drum 2, which process cartridge can be mounted to and detached from the main body of the electrophotographic image forming apparatus. The present invention is also applicable to the developing cartridge including integrally the developing roller 25 for developing the electrostatic latent image formed on the photosensitive drum 2 and the developer containing portions for containing the developers used for developing the electrostatic latent image by the developing roller 25, which developing cartridge can be mounted to and detached from the apparatus main body A. The present invention is not limited to the structure in which the mounting portion is provided to the rotary. For example, the mounting portion may be provided to the main body in a fixed manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-128988, filed May 15, 2007 and 2008-112004, filed Apr. 23, 2008, which are hereby incorporated by reference herein in their entirety.

What is claimed is:

1. An electrophotographic image forming apparatus to which a cartridge is detachably mountable to form an image on a recording medium, the electrophotographic image forming apparatus comprising:

a mounting portion to which the cartridge is detachably mountable;

a cartridge holding member which holds the cartridge to move the cartridge to the mounting portion;

a lock member which releasably locks the cartridge to the cartridge holding member;

a lock releasing member which releases the lock of the cartridge to the cartridge holding member by the lock member after the cartridge holding member moves the cartridge to the mounting portion;

a mounting portion locking member which releasably locks the cartridge to the mounting portion; and a mounting portion lock releasing member which releases the lock of the cartridge to the mounting portion by the mounting potion locking member when the cartridge is removed from the mounting portion.

2. An electrophotographic image forming apparatus to which a cartridge is detachably mountable to form an image on a recording medium, the electrophotographic image forming apparatus comprising:

an opening portion through which the cartridge is passed when the cartridge is to be mounted to a main body of the electrophotographic image forming apparatus and when the cartridge is to be detached from the main body;

an openable and closable member which openably closes the opening portion;

a mounting portion to which the cartridge is detachably mountable;

a cartridge holding member which holds the cartridge to move the cartridge to the mounting portion, the cartridge holding member assuming an outside position located outside of the opening portion to allow the cartridge holding member to hold the cartridge and an inside position located inside of the opening portion to move the cartridge held by the cartridge holding member to the mounting portion;

a lock member which releasably locks the cartridge to the cartridge holding member;

a lock releasing member which releases the lock of the cartridge to the cartridge holding member by the lock member after the cartridge holding member moves the cartridge to the mounting portion, the lock releasing member being provided on an inner side of the openable and closable member;

a mounting portion locking member which releasably locks the cartridge to the mounting portion; and a mounting portion lock releasing member which releases the lock of the cartridge to the mounting portion by the mounting potion locking member when the cartridge is removed from the mounting portion.

3. An electrophotographic image forming apparatus to which a cartridge is detachably mountable to form an image on a recording medium, the electrophotographic image forming apparatus comprising:

an opening portion through which the cartridge is passed when the cartridge is to be mounted to a main body of the electrophotographic image forming apparatus and when the cartridge is to be detached from the main body;

an openable and closable member which openably closes the opening portion;

a mounting portion to which the cartridge is detachably mountable;

a cartridge holding member which holds the cartridge to move the cartridge to the mounting portion, the cartridge holding member assuming an outside position located outside of the opening portion to allow the cartridge holding member to hold the cartridge and an inside position located inside of the opening portion to move the cartridge held by the cartridge holding member to the mounting portion;

a lock member which releasably locks the cartridge to the cartridge holding member;

a mounting portion locking member which releasably locks the cartridge to the mounting portion;

a lock releasing member which releases the lock of the cartridge to the cartridge holding member by the lock member after the cartridge holding member moves the cartridge to the mounting portion, the lock releasing member being provided on an inner side of the openable and closable member; and a mounting portion lock releasing member which releases the lock of the cartridge to the mounting portion by the mounting portion locking member when the openable and closable member is opened, the mounting portion lock releasing member being provided on the inner side of the openable and closable member.

4. An electrophotographic image forming apparatus according to claim 1, wherein the cartridge is a process cartridge including integrally an electrophotographic photosensitive drum and a process member acting on the electrophotographic photosensitive drum, the process cartridge being detachably mountable to a main body of the electrophotographic image forming apparatus, or wherein the cartridge is a developing cartridge including integrally a developing roller which develops an electrostatic latent image formed on the electrophotographic photosensitive drum and a developer containing portion which contains a developer used by the developing roller to develop the electrostatic latent image, the developing cartridge being detachably mountable to the main body.

5. An electrophotographic image forming apparatus according to claim 1, wherein the electrophotographic image forming apparatus is a color electrophotographic image forming apparatus comprising a plurality of mounting portions which are provided to a rotatable rotary, wherein a plurality of developing cartridges containing developers of different colors are mountable to the plurality of mounting portions, respectively.

6. A cartridge detachably mountable to a main body of an electrophotographic image forming apparatus for forming an image on a recording medium, the cartridge comprising:

a first locked portion to be releasably locked to a lock member to lock the cartridge to a cartridge holding member which moves the cartridge from outside of the main body to a mounting portion provided in the main body when the cartridge is mounted to the mounting portion; and a second locked portion to be releasably locked to a mounting portion locking member to releasably lock the cartridge to the mounting portion, wherein a lock state of the first locked potion to the lock member is released while the cartridge is being mounted to the mounting portion, and a lock state of the second locked portion to the mounting portion locking member is released when the cartridge is to be detached from the mounting portion.

7. A cartridge according to claim 6, wherein the cartridge is a process cartridge including integrally an electrophotographic photosensitive drum and a process member acting on the electrophotographic photosensitive drum, the process cartridge being detachably mountable to the main body of the electrophotographic image forming apparatus, or wherein the cartridge is a developing cartridge including integrally a developing roller which develops an electrostatic latent image formed on the electrophotographic photosensitive drum and a developer containing portion which contains a developer used by the developing roller to develop the electrostatic latent image, the developing cartridge being detachably mountable to the main body.

8. A cartridge holding member for moving a cartridge to a mounting portion provided in a main body of an electrophotographic image forming apparatus for forming an image on a recording medium, the cartridge holding member comprising:

a lock member to be releasably locked to a first locked portion of the cartridge to move the cartridge from outside of the main body to the mounting portion when the cartridge is to be mounted to the mounting portion; and a space portion provided for allowing a lock releasing member provided in the main body to be brought into contact with the lock member to release a lock state by the lock member.

9. A cartridge holding member according to claim 8, further comprising an operating portion used by an operator to operate the cartridge holding member when the cartridge holding member moves the cartridge to the mounting portion.

10. A cartridge holding member according to claim 9, wherein the operating portion is a gripper to be gripped by the operator to carry the cartridge holding member, or wherein the operating portion is a gripper to be gripped by the operator to move the cartridge holding member rotatably mounted to the main body into the main body.

11. An electrophotographic image forming apparatus which forms an image on a recording medium, the electrophotographic image forming apparatus comprising:

a mounting portion to which a cartridge is detachably mountable;

a cartridge holding member which holds the cartridge to move the cartridge to the mounting portion;

a lock member which is provided on the cartridge holding member, and which reliably locks the cartridge to the cartridge holding member;

a lock releasing member which releases the lock of the cartridge to the cartridge holding member by the lock member after the cartridge holding member moves the cartridge to the mounting portion; and a space portion which is provided in the cartridge holding member for allowing the lock releasing member to be brought into contact with the lock member to release the lock of the cartridge to the cartridge holding member by the lock member.

12. An electrophotographic image forming apparatus according to claim 11, further comprising:

a mounting portion locking member which releasably locks the cartridge to the mounting portion; and a mounting portion lock releasing member which releases the lock of the cartridge to the mounting portion by the mounting portion locking member when the cartridge is removed from the mounting portion.

* * * * *